US008567699B2

(12) United States Patent
Sesser et al.

(10) Patent No.: US 8,567,699 B2
(45) Date of Patent: Oct. 29, 2013

(54) ROTARY STRUT SPRINKLER

(75) Inventors: George L. Sesser, Walla Walla, WA (US); Craig B. Nelson, Walla Walla, WA (US)

(73) Assignee: Nelson Irrigation Corporation, Walla Walla, WA (US)

( * ) Notice: Subject to any disclaimer, the term of this patent is extended or adjusted under 35 U.S.C. 154(b) by 561 days.

(21) Appl. No.: 12/536,204

(22) Filed: Aug. 5, 2009

(65) Prior Publication Data

US 2011/0031332 A1 Feb. 10, 2011

(51) Int. Cl.

| | |
|---|---|
| ***B05B 3/02*** | (2006.01) |
| ***B05B 3/06*** | (2006.01) |
| ***B05B 3/04*** | (2006.01) |
| ***F23D 11/04*** | (2006.01) |

(52) U.S. Cl.

USPC ..... 239/252; 239/222.11; 239/222.17; 239/230; 239/231; 239/251; 239/256; 239/263

(58) Field of Classification Search

USPC ..... 239/214, 222.11, 222.17, 222.21, 230, 239/231, 232, 233, 251, 252, 263; 188/83, 188/268

See application file for complete search history.

(56) References Cited

U.S. PATENT DOCUMENTS

| | | | | |
|---|---|---|---|---|
| 2,910,246 | A | 10/1959 | Hait | |
| 4,660,766 | A * | 4/1987 | Nelson et al. | 239/222.17 |
| 4,717,073 | A | 1/1988 | Bielka | |
| RE33,823 | E * | 2/1992 | Nelson et al. | 239/222.17 |
| 6,135,364 | A * | 10/2000 | Nickish | 239/222.17 |
| 6,854,668 | B2 | 2/2005 | Wancho et al. | |
| 7,100,842 | B2 * | 9/2006 | Meyer et al. | 239/214 |
| 7,287,710 | B1 * | 10/2007 | Nelson et al. | 239/222.17 |
| 2004/0195362 | A1 | 10/2004 | Walker | |
| 2004/0262426 | A1 * | 12/2004 | Antonucci et al. | 239/233 |
| 2006/0249594 | A1 | 11/2006 | Pinch | |
| 2008/0054093 | A1 * | 3/2008 | Nelson et al. | 239/222.21 |
| 2008/0054094 | A1 * | 3/2008 | Nelson et al. | 239/222.21 |

* cited by examiner

*Primary Examiner* — Ryan Reis
(74) *Attorney, Agent, or Firm* — Nixon & Vanderhye, P.C.

(57) ABSTRACT

A rotary sprinkler includes a sprinkler body including a nozzle, a water-deflection plate supported for rotational movement relative to the sprinkler body, the water-deflection plate having one or more grooves configured to cause the water-deflection plate to rotate when impinged upon by a stream emitted from the nozzle; a first brake arranged to slow rotation of the water-deflection plate at all times; and a second brake arranged to further slow rotation of the water-deflection plate as a function of water pressure exerted on the water-deflection plate.

20 Claims, 14 Drawing Sheets

ROTARY STRUT SPRINKLER

This invention relates generally to sprinklers and, more particularly, to rotary sprinklers with internal braking mechanisms for slowing the speed of rotation of a water-deflection plate that radially disburses a stream emitted from the sprinkler nozzle.

BACKGROUND OF THE INVENTION

Rotating sprinklers are often employed on traveling irrigation machines such as center-pivot machines, lateral-move machines, etc. Typically, the sprinklers are attached to the lower end of a rigid water supply pipe (or a flexible water supply hose) descending from a lateral boom on a traveling irrigation machine or from a stationary overhead water manifold as commonly used in greenhouses and riding arenas. One such rotating sprinkler is built around a quick-change nozzle and adapter system as described in U.S. Pat. No. 5,415,348. The rotating sprinkler described in the '348 patent has proven to be reliable and durable, but has drawbacks stemming from the fact that the water exiting the water-deflection plate has to flow across three stationary struts that support the deflection plate downstream of the nozzle. While the struts are narrow and formed with sharp leading edges to minimize disruption of the stream, stringy material in the water can loop about one or more of the struts and build up to the point of significantly disrupting the stream, or even stalling rotation of the water-deflection plate. In addition, the struts leave dry, narrow "shadows" in the wetted pattern. It has also been found that a noticeable amount of water passing over the struts does not spray outward but, rather, drips down directly underneath the sprinkler. In addition, the diameter of the water-deflection plate is limited by the radial placement of the struts, which sometimes results in geometry on the water-deflection plate that limits the radius-of-throw of the unit.

It is also desirable to provide a sprinkler that maintains a substantially constant speed of rotation while accommodating line pressure and nozzle size variations, whether of the braked or free-spinning type.

There remains a need, therefore, for a rotating sprinkler that addresses these problems in a reliable and cost-effective manner.

BRIEF DESCRIPTION OF THE INVENTION

In the exemplary but nonlimiting embodiments described herein, a sprinkler body is constructed so as to support a water-deflection plate with struts that rotate along with the water-deflection plate. The water-deflection plate itself is designed to direct the stream around the struts without contacting the struts. In the exemplary embodiments, two struts are utilized to support the water-deflection plate, but one or more than two struts could be utilized.

Another feature of the sprinkler designs disclosed herein relates to the exterior design of the sprinkler housing. More specifically, the housing is designed to catch any flow along the supply hose or the supply pipe and direct it into the multiple streams exiting the water-deflection plate, so that this "down flow" is flung out away from the sprinkler by joining the normally exiting streams rather than dripping or drooling directly underneath the sprinkler. This is accomplished by taking advantage of water's natural tendency to adhere to smooth flowing surfaces via surface tension and capillary action.

Another feature of the embodiments described herein relates to the use of a rotary damper for slowing the speed of the water-deflection plate. In the past, sprinkler units have employed rotary dampers arranged coaxially with the nozzle axis (and with the axis of rotation of the deflection plate). In the embodiments described herein, a rotary damper is employed that is offset from the nozzle axis, and is driven by gears or other means, for example, a drive belt, chain and sprockets, magnets, etc. Locating the rotary damper to one side of the sprinkler axis of rotation has the advantage of lower seal drag, which is a significant concern with sprinklers of this type since the available drive torque is relatively low. The sprinklers in the '823 and '291 patents have relatively large diameter seals that seal the damping fluid. Damping fluids are typically difficult to keep sealed, however, i.e., the fluid leaks out, and/or may be contaminated by any water that leaks in, necessitating the use of dual-lip seals that stretch tightly over the shaft, creating high seal drag. In the embodiments described herein, a very small diameter shaft is used for the rotary damper so that seal drag is minimal. Two larger rotary seals used in connection with the larger diameter deflection plate shaft are only sealing grease, so that they can be relatively loose-fitting, single-lip seals and still perform adequately.

Another feature of the sprinkler designs disclosed herein relates to the incorporation of a second, independent braking device in the form of a compensating, multi-disc friction brake mechanism to help maintain the rotational speed of the water-deflection plate relatively constant over a wide range of nozzle sizes and line pressure variations. Water striking the water-deflection plate creates an axial load which is transferred by the frame to the housing. With small nozzles and low line pressures, very little axial load is developed by water striking the water-deflection plate. In the nonlimiting embodiments described herein, a wave (or other) spring transfers the axial load to the sprinkler hub and prevents actuation of the disc brake, so that speed is controlled primarily by the rotary damper. As nozzle size and line pressure increase, however, the extra axial load is carried by the brake discs to the brake hub, which, in turn, is locked to the inner stem of the nonrotatable sprinkler body. A first group of static brake discs floats freely axially on the brake hub. The discs are prevented from rotating by cooperating ribs and grooves. A second group of rotating brake discs floats freely axially in the housing, but these discs are caused to rotate with the housing, also by cooperating ribs and grooves. In the exemplary embodiment, the first and second groups of discs are interleaved with each other. It is this interaction of the discs when compressed as line pressure increases that creates the supplemental braking effect. Water flowing through the grooves on the water-deflection plate creates the torque to drive, i.e., rotate, the water-deflection plate. The braking torque generated by the disc brake increases proportionally to the increase in drive torque, thus maintaining the rotation speed of the water-deflection plate relatively constant.

Another feature of the invention relates to the incorporation of a "dummy" boss symmetrically placed opposite the rotary damper boss or housing. This helps the unit hang straight when mounted on a flexible supply hose, and reduces twisting of the unit when dragging through a crop. The dummy boss also provides a handgrip for torqing the sprinkler unit onto an adapter. In an alternative arrangement, the dummy boss is eliminated and the rotary damper is mounted such that it rotates along with the water-deflection plate. This arrangement has drawbacks in that a much larger portion of the sprinkler is rotating when in operation and as a result, it is easier for external obstacles, such as corn stalks, to stall the rotation. On the other hand, the advantage of this design is that a pair of rotary seals (i.e., the stem seals) are both relatively small in diameter.

In still another alternative embodiment, the rotary damper is eliminated and the unit is therefore free to rotate at a relatively high whirling speed to facilitate breakup of the stream which, in turn, helps the water infiltrate the soil better in some situations. This design retains the compensating multi-disc friction brake and an associated spring that prevents the disc brake from actuating with small nozzles and low line pressures. The friction brake is advantageous because with small nozzles and low line pressures, the only drag is seal drag and bearing friction. With sufficient drive built into the water-deflection plate, the unit will spin as desired with small nozzles and low pressure, but absent the rotary damper, might spin overly fast with larger nozzles and higher line pressures if not for the multi-disc friction brake.

Accordingly, in one aspect, the present invention relates to a rotary sprinkler comprising a sprinkler body including a nozzle, a water-deflection plate supported for rotational movement relative to the sprinkler body, the water-deflection plate having one or more grooves configured to cause the water-deflection plate to rotate when impinged upon by a stream emitted from the nozzle; a first brake arranged to slow rotation of the water-deflection plate at all times, and a second brake arranged to further slow rotation of the water-deflection plate as a function of water pressure exerted on the water-deflection plate.

In another aspect, the invention relates to a rotary sprinkler comprising a sprinkler body including a nozzle, a water-deflection plate supported on a first shaft for rotational movement relative to the sprinkler body, the water-deflection plate having one or more grooves configured to cause the water-deflection plate to rotate when impinged upon by a stream emitted from the nozzle; a viscous brake operatively connected to the water-deflection plate, the viscous brake including a rotor fixed to a second shaft arranged parallel to the first shaft.

In still another aspect, the invention relates to a rotary sprinkler comprising a sprinkler body including a nozzle, a water-deflection plate supported for rotational movement relative to the sprinkler body, the water-deflection plate having one or more grooves configured to cause the water-deflection plate to rotate when impinged upon by a stream emitted from the nozzle; a brake mechanism adapted to slow rotation of the deflection plate as a function of water pressure exerted on the deflection plate; and wherein the water-deflection plate is supported for limited axial movement along a longitudinal axis extending through the nozzle, the second brake actuated by axial movement of the water-deflection plate away from the nozzle.

The invention will now be described in detail in connection with the drawings identified below.

DETAILED DESCRIPTION OF THE INVENTION

Figure 1:
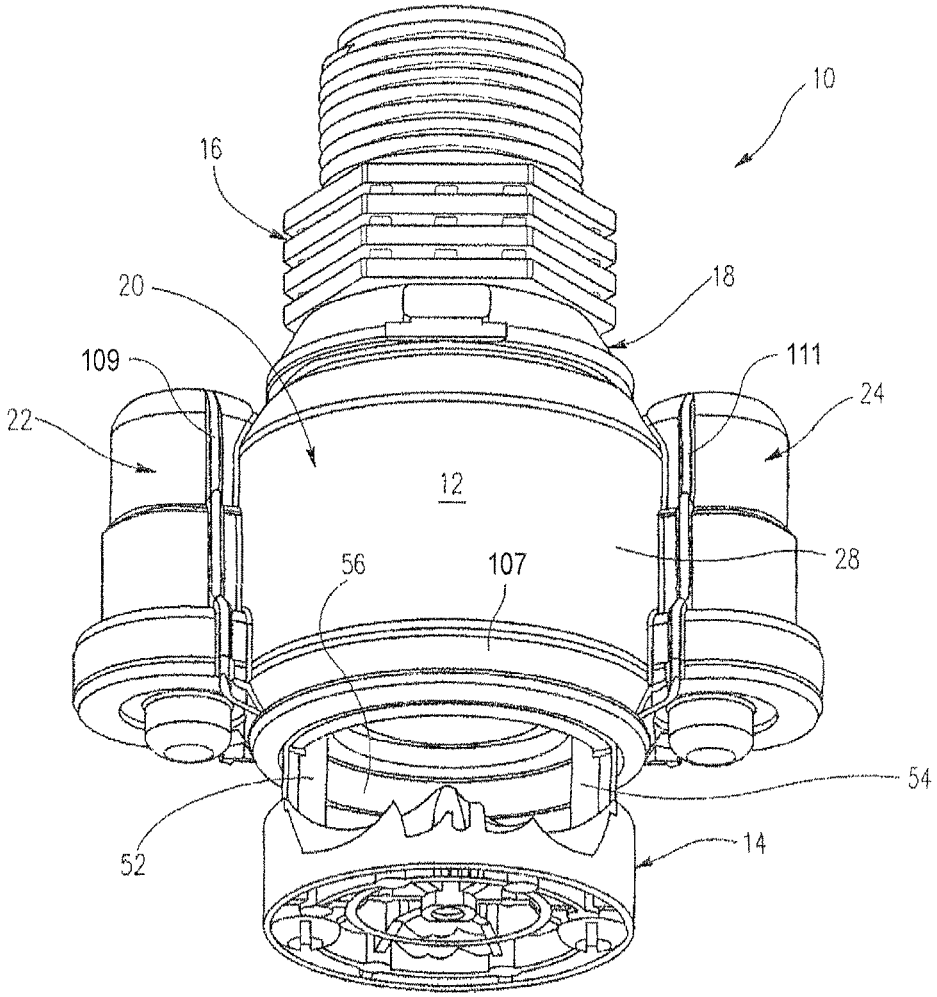
FIG. 1 is a lower perspective view of an exemplary but nonlimiting embodiment of the invention.
Figure 2:
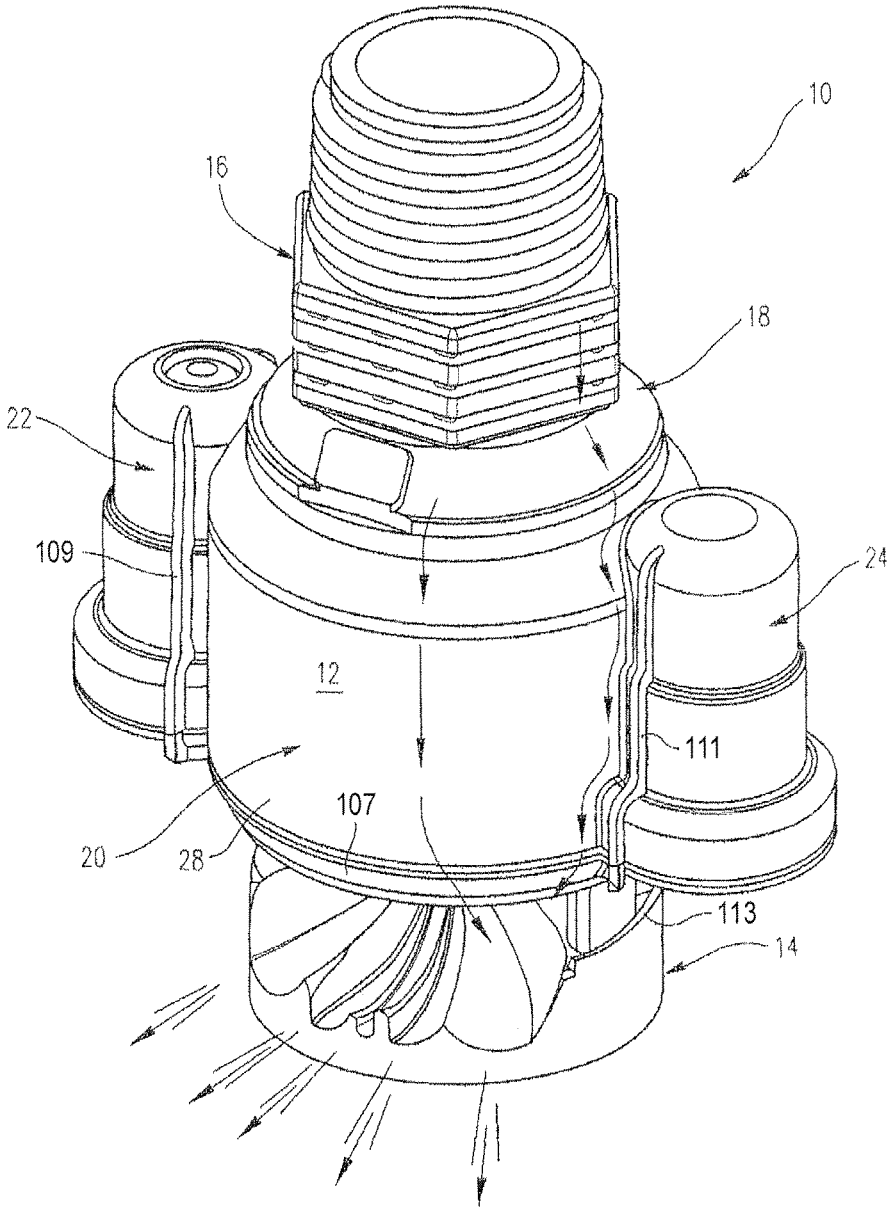
FIG. 2 is an upper perspective view of the sprinkler shown in FIG. 1.
Figure 3:
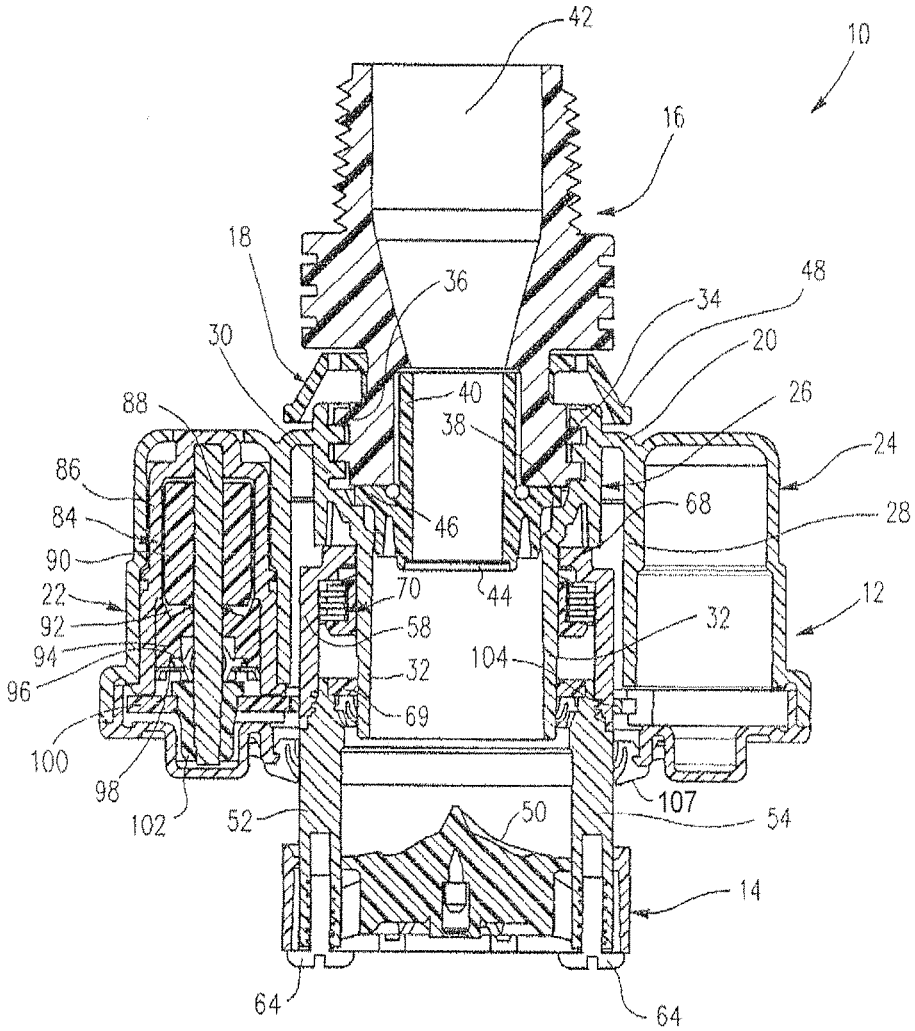
FIG. 3 is a cross section of the sprinkler shown in FIGS. 1 and 2.

With reference initially to FIGS. 1 to 3, a sprinkler 10 in accordance with an exemplary and nonlimiting embodiment of this disclosure includes a sprinkler body housing 12 that supports a rotatable water-deflection (or distribution) plate 14 at one end thereof. An adapter 16 is threaded into the sprinkler body at the opposite end thereof, with a replaceable nozzle 18 sandwiched between the adapter and the sprinkler body. The sprinkler body housing 12 includes a substantially cylindrical center body portion 20 and a pair of diametrically opposed, smaller side housings 22 and 24.

With reference especially to FIG. 3, the center body portion 20 of the sprinkler is formed with an inner cylindrical wall 26, spaced radially and concentrically inwardly of an outer cylindrical wall 28. The inner cylindrical wall 26 is formed with an upper cylindrical wall portion 30 and a lower cylindrical wall portion 32, the lower wall portion 32 having a diameter less than the upper wall portion 30. The upper wall portion 30 is internally threaded at 34 so as to receive external threads 36 on the lower part of the adapter 16. Between the upper and lower wall portions 30 and 32, there is a horizontal shoulder or seat 38 on which the nozzle 18 rests. In this regard, the nozzle 18 includes a cylindrical center wall 40 that forms a flow passage axially between the interior passage 42 of the adapter 16 and the nozzle orifice 44. A radial flange 46 is adapted to seat on the shoulder 38 with the lower end of the adapter 16 engaged with the upper surface of the flange 46 when the adapter is threaded into the body. A surrounding band 48, integrally formed with the nozzle, is used to provide the user with plainly visible nozzle size or other relevant information. It will be understood that the nozzle 18 is easily replaceable by removing the adapter 16, removing the nozzle and sliding a new nozzle into place, and then re-threading the adapter to the sprinkler body. This arrangement, per se, is known from commonly-owned U.S. Pat. No. 5,415,348.

Figure 5:
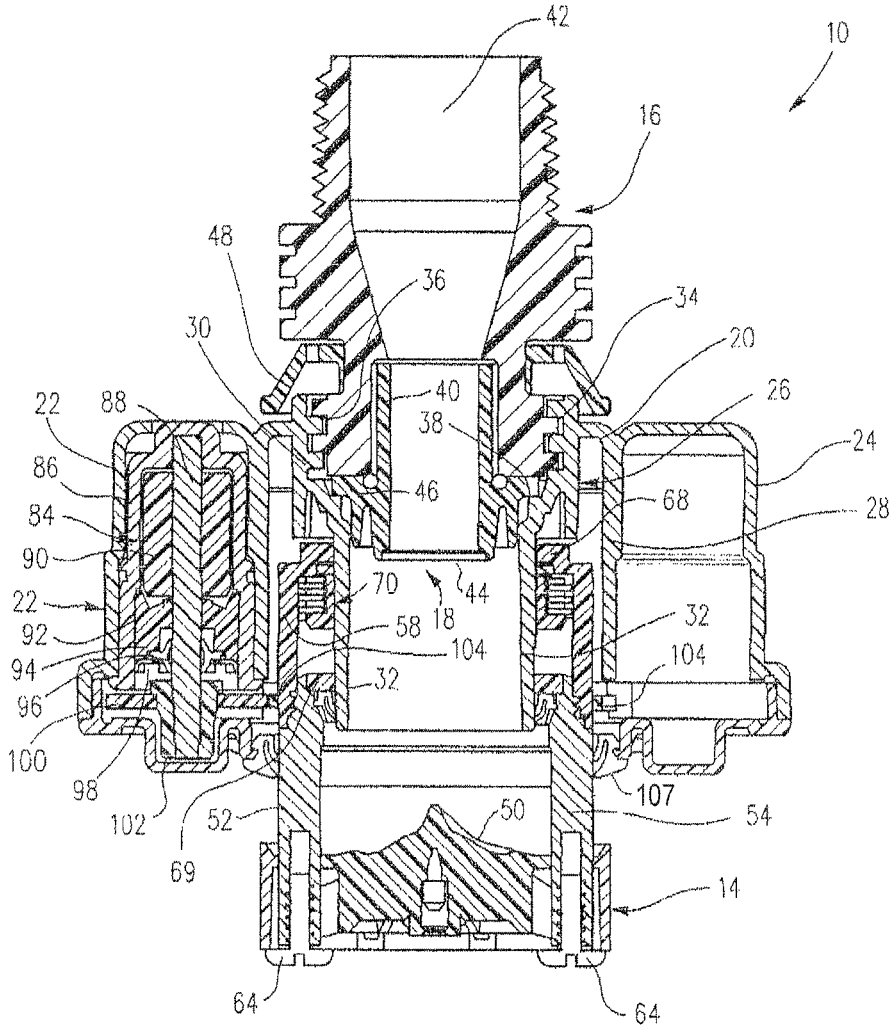
FIG. 5 is a cross section similar to FIG. 3 but with the water-deflection plate moved axially downward to a position assumed under large nozzle size and/or high line pressure conditions.
Figure 6:
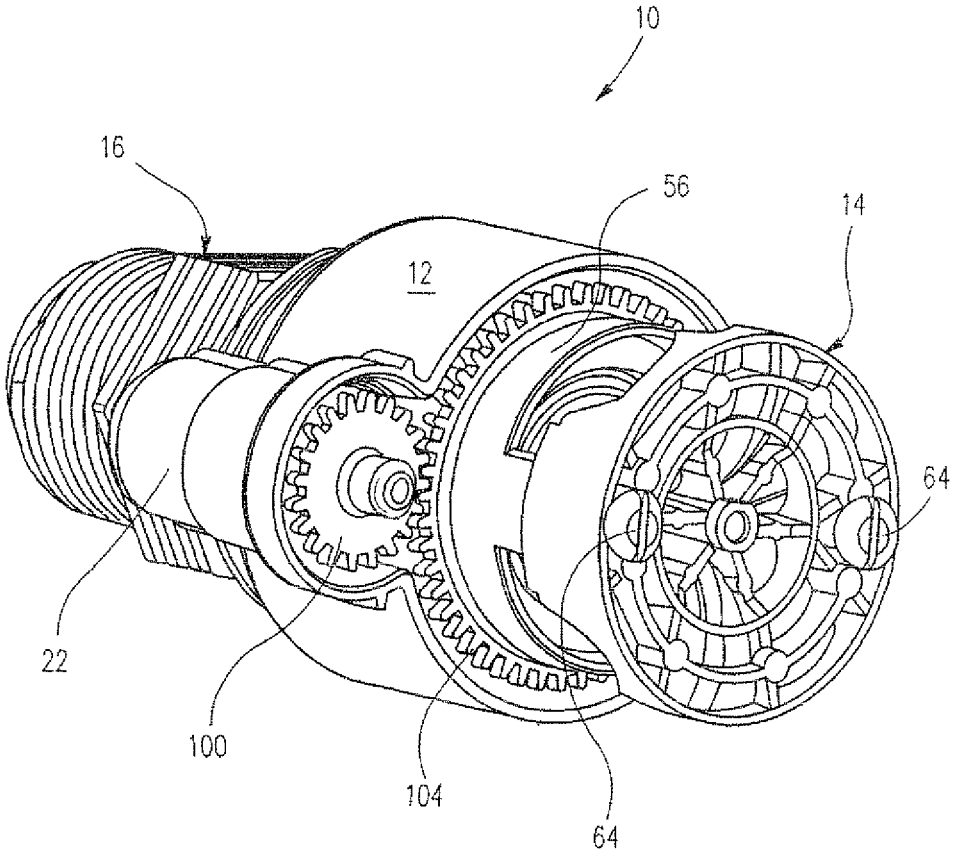
FIG. 6 is a bottom right perspective view of the sprinkler shown in FIGS. 1-3 and 5 but with parts removed to better illustrate the gear drive mechanism internal to the sprinkler.

The water-deflection plate 14 is formed with a plurality of grooves 50 that are shaped and arranged in a known manner to cause the plate to rotate when a stream emitted from the nozzle orifice 44 strikes the plate and divides itself into plural streams thrown radially away from the deflection plate. The deflection plate 14 is supported in axially-spaced relationship to the nozzle 18 by means of a pair of struts or posts 52, 54 extending from an annular support ring 56 that is threadably mounted within a substantially cylindrical, rotatable, and axially-moveable sleeve 58 supported between the inner and outer walls of the sprinkler body, as best seen in FIGS. 3 and 5.

Figure 4:
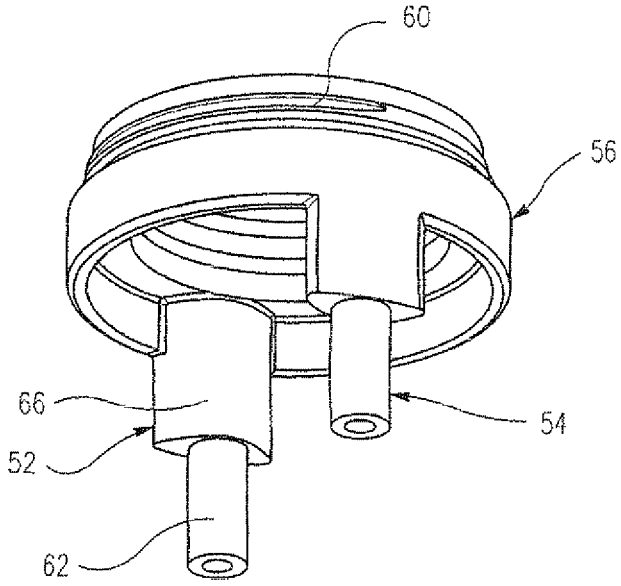
FIG. 4 is a perspective view of an annular support ring taken from the sprinkler shown in FIGS. 1-3.

With specific reference to FIG. 4, it can be seen that the annular support ring 56 is provided with a threaded portion 60 employed to secure the ring to the axially-moveable sleeve 58. The posts or struts 52, 54 are identical, and therefore, only one need be further described. Strut 52, for example, is formed with a cylindrical portion 62 that is received within the deflection plate 14. Portion 62 is internally threaded and adapted to receive a screw fastener 64 as shown in FIG. 3. Thus, the water-deflection plate 14 is secured to the sprinkler body by means of a pair of similar screws 64, threaded into the posts 52, 54. Those portions of the posts 52, 54 interposed between the sleeve 58 and the annular support ring 56 are formed with blade-shaped profiles 66, providing a more aerodynamic shape that facilitates rotation of the water-deflection plate 14.

Returning to FIG. 3, the sleeve 58, along with the deflection plate 14, is axially moveable relative to the sprinkler body housing 12. In this regard, the end of the sleeve 58 remote from the deflection plate 14 is formed with a radially inwardly facing flange or upper bearing 68 that engages the lower cylindrical wall portion 32 a manner that, in combination with a lower sleeve bearing 69 permits sliding movement of the sleeve relative to the lower cylindrical wall portion 32 as will be described further herein below.

Figure 7:
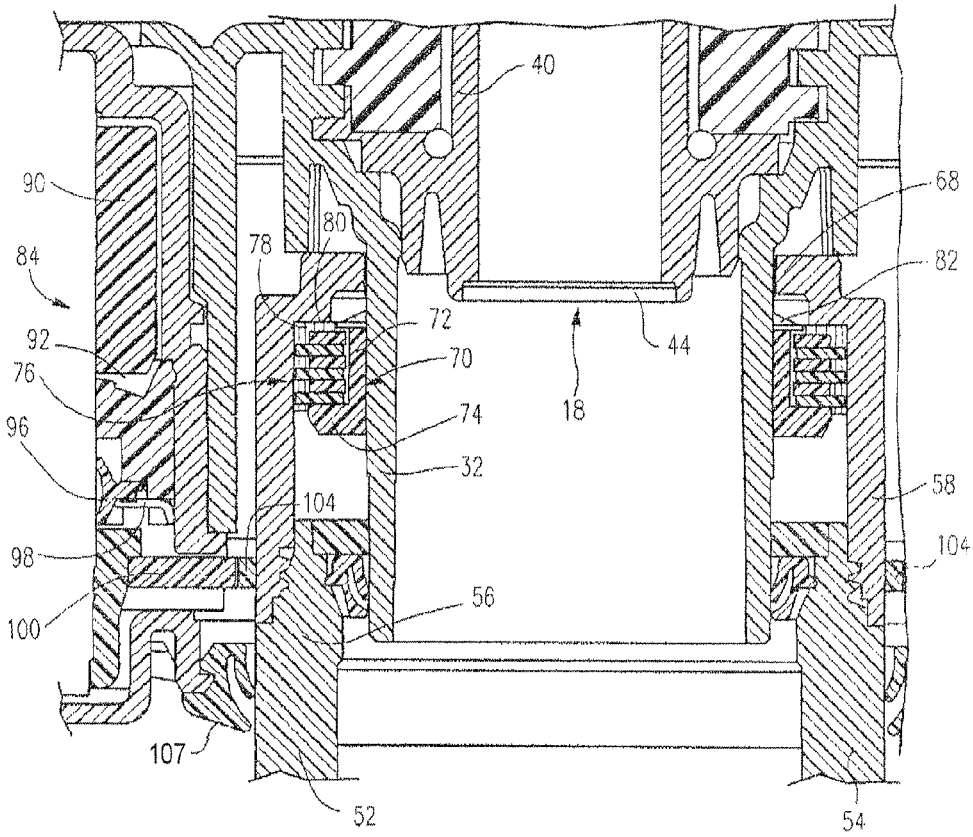
FIG. 7 is an enlarged detail of a part of the sprinkler illustrated in FIG. 3.

As perhaps best seen in FIG. 7, a brake hub 70, in the form of an annular flanged ring, is press-fit over the lower wall portion 32 of the inner wall 26 and includes a cylindrical sleeve portion 72 and a lower radial flange 74 on which are supported a plurality of brake discs 76 to be described further below. Of significance is the fact that, when there is no water under pressure flowing through the sprinkler, there is an axial gap 78 between the uppermost of the brake discs and an inner horizontal surface 80 of the sleeve 58. It is this gap that substantially defines the extent of axial movement of the sleeve 58 relative to the sprinkler body housing 12. More specifically, as water emitted from the nozzle strikes the deflection plate 14, both the deflection plate 14 and the sleeve 58 rotate about the lower wall portion 32 of the sprinkler body housing. At the same time, the water pressure (or line pressure) causes the deflection plate 14 and sleeve 58 to move axially downwardly (relative to the orientation in FIG. 3) against the bias of an annular wave spring 82 (see FIG. 8A) interposed between the fixed brake hub 70 and the flange 68 of the sleeve 58. The circumstances under which the axial movement of the sleeve 58 and brake discs 76 are employed to slow the rotation of the water-deflection plate 14 will also be described in further detail below.

Notwithstanding the above-described brake arrangement, rotation of the water-deflection plate 14 is slowed on a continual basis by the viscous motor 84 located within the side housing 22. Specifically, and with reference to FIGS. 3, 5, 7, 8 and 8A, the viscous motor 84 includes a housing 86 in which a shaft 88 is secured for rotation relative to the housing. A rotor element 90 is fixed to the shaft for rotation therewith, within an internal sealed chamber 92 of the housing that is filled or at least partially filled with a viscous fluid, for example, silicone. The open (lower) end of the housing 86 is sealed by a bearing cap 94 and a double-lip seal 96, both held in place by a retainer 98. The shaft 88 extends out of the motor housing 86 and supports a first ring gear 100 on a hub 102 fixed to the shaft 88 for rotation therewith. Gear 100 meshes with a second ring gear 104 fixed to the lower end of the sleeve 58. Thus, as the deflection plate 14 and sleeve 58 rotate, the speed of rotation is slowed by the viscous shearing between the rotor 90 and the fluid within the motor housing 86 via the drive connection between gears 100 and 104. Note that in the event of axial movement of sleeve 58, the gear 100 can also move axially relative to the fixed ring gear 104 with no impact on the drive arrangement between the gears.

Figure 8:
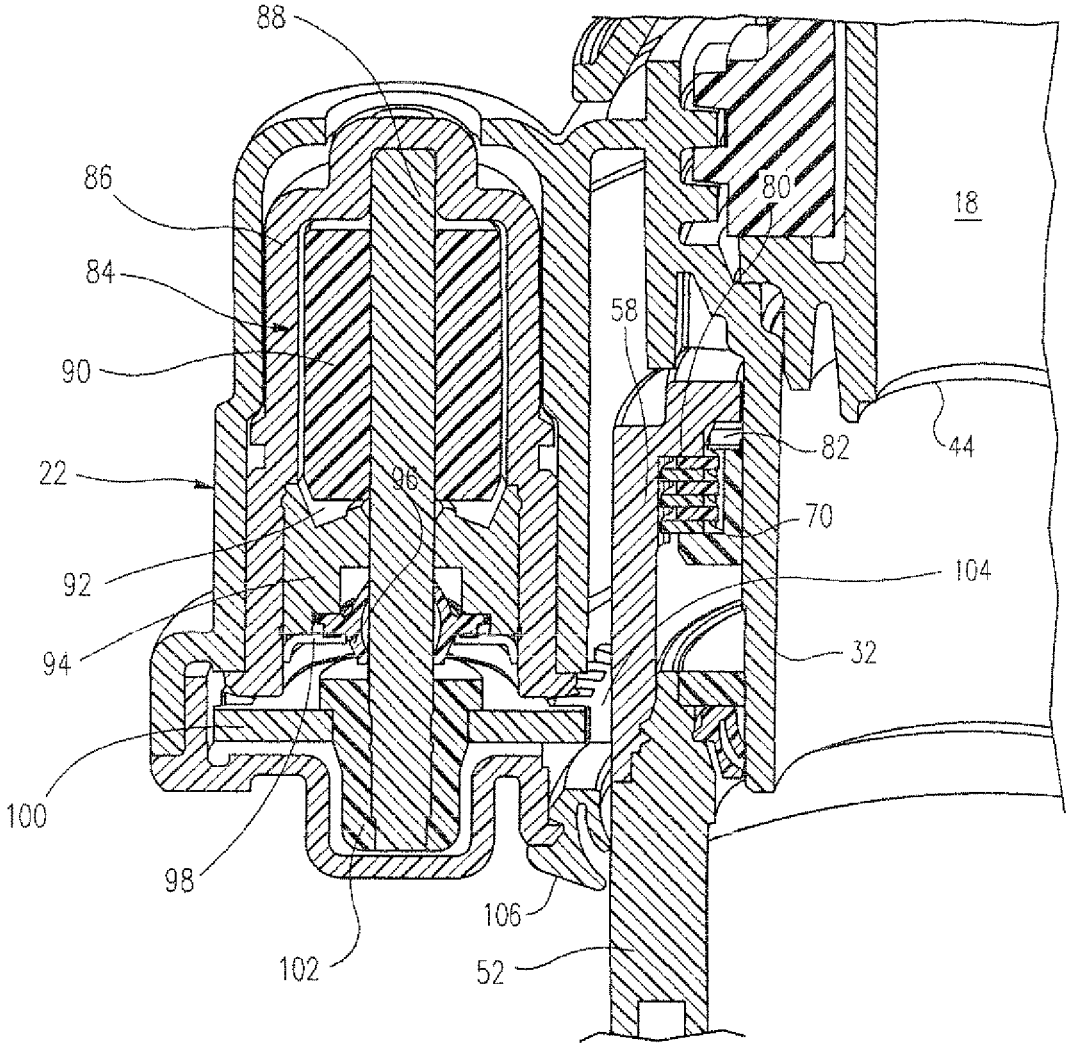
FIG. 8 is an enlarged perspective view of a portion of the sprinkler shown in FIG. 5.
Figure 8A:
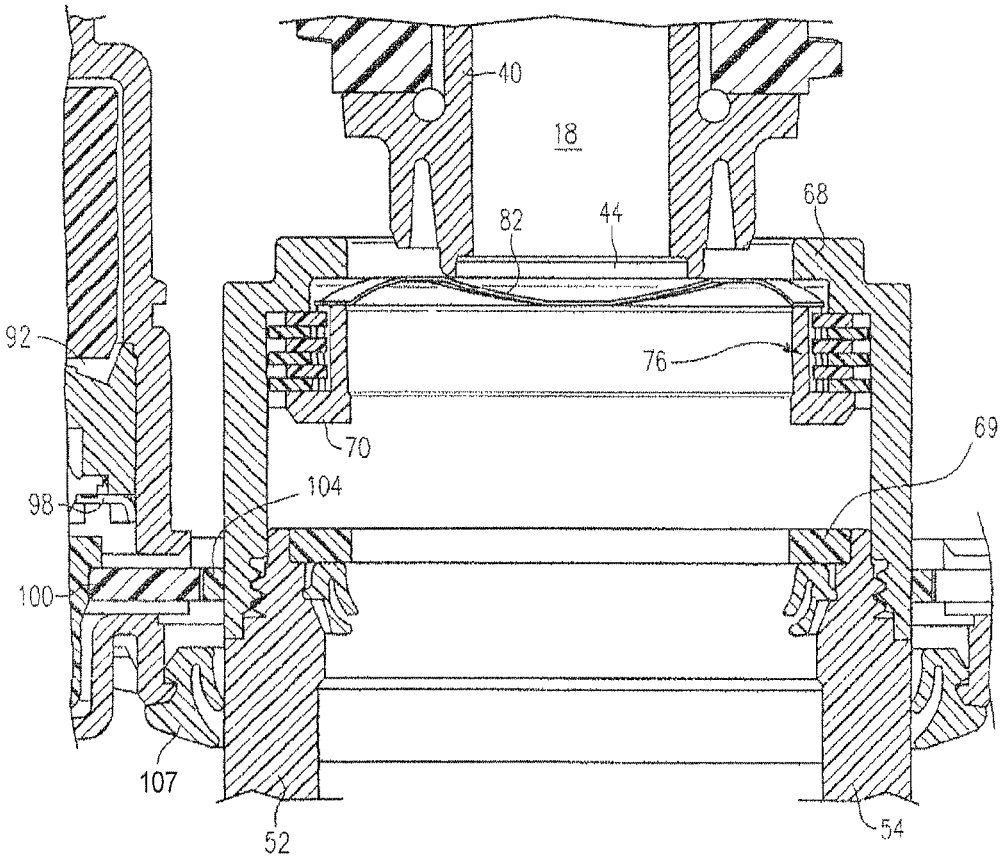
FIG. 8A is a view similar to FIG. 7, but with the sprinkler housing removed.
Figure 9:
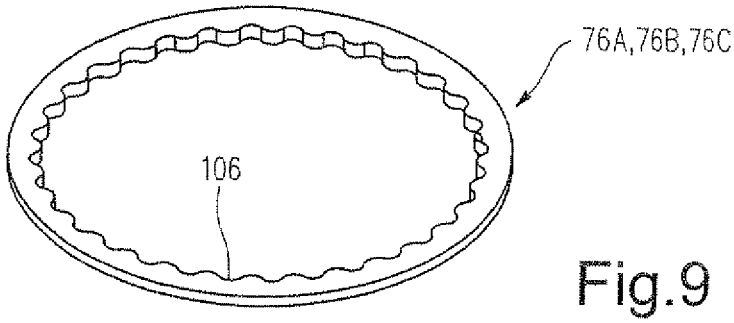
FIG. 9 is a perspective view of a stationary brake disc utilized in the sprinkler shown in FIGS. 1-8.
Figure 10:
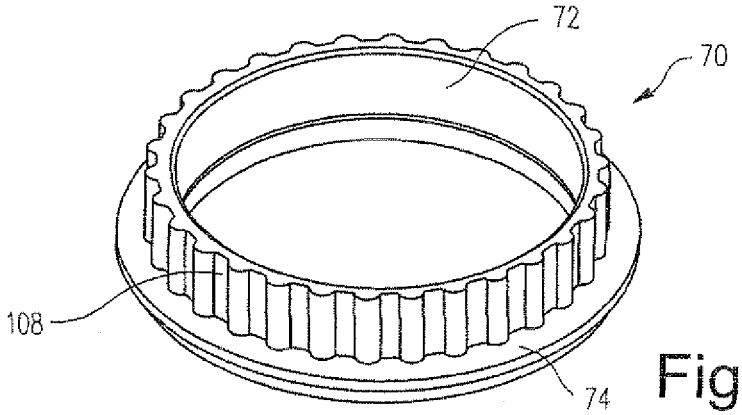
FIG. 10 is a perspective view of a brake hub utilized in the sprinkler shown in FIGS. 1-8.
Figure 11:
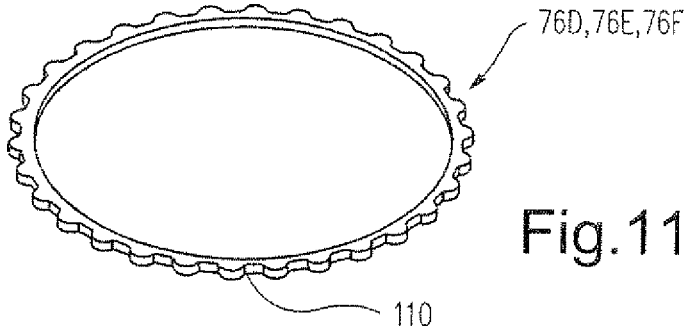
FIG. 11 is a perspective view of a rotatable brake disc utilized in the sprinkler shown in FIGS. 1-8.
Figure 12:
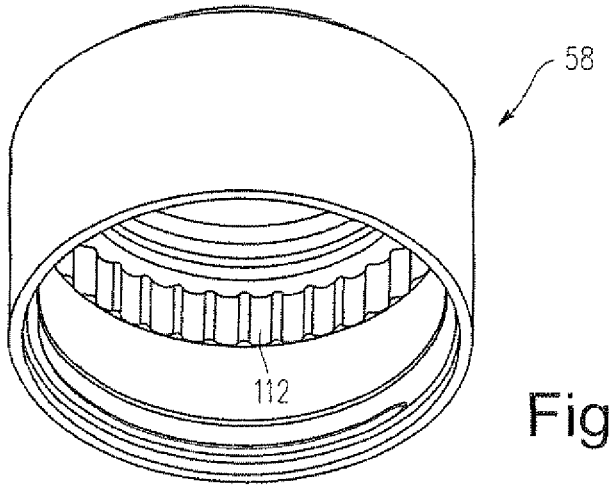
FIG. 12 is a bottom perspective view of an axially-moveable and rotatable sleeve component taken from the sprinkler shown in FIGS. 1-8.

With small nozzles and/or low line pressures, very little axial load is developed by water striking the water-deflection plate 14. Under these conditions, the wave spring 82 transfers the axial load to the center body portion 20 of the housing 12 and prevents actuation of the brake discs 76, so that speed is controlled only by the viscous motor or damper 84. (See FIGS. 3 and 7.) As nozzle size and line pressure increase, however, the deflection plate 14 and sleeve 58 move downwardly against the bias of spring 82, until flange 80 of sleeve 58 engages the brake discs 76 as shown in FIGS. 5 and 8. Now, the extra axial load is carried by the brake discs 76 to the fixed brake hub 70. The brake hub 70 is locked to the lower wall portion 32 of the inner wall 26 of the sprinkler center body portion 20 which does not rotate, and hence, the brake discs 76 resist rotation of the sleeve 58 and deflection plate 14. In this regard, note that certain of the discs 76 are permitted to rotate with the sleeve 58 and others are held stationary. Specifically, and with further reference to FIG. 9, the discs 76A, B and C are held stationary by reason of radially inner flutes (or ribs) 106 engaged with axial grooves 108 (see FIG. 10) formed on the exterior side of the cylindrical surface 72 of the hub 70. Intermeshed discs 76D, E and F (FIG. 11) are formed with radially outer flutes or ribs 110 that are engaged with axial grooves 112 (see FIG. 12) formed on the inner surface of the sleeve 58. There is grease in the brake disc area, and the number of brake discs can vary as needed. Compression of the discs 76 by sleeve 58, and the friction created by the alternating stationary/rotatable discs, creates the braking force on the sleeve 58 and hence the deflection plate 14. The braking torque of the discs 76 increases proportionally with the increase in drive torque created by the water, keeping the rotation speed relatively constant.

Figure 13:
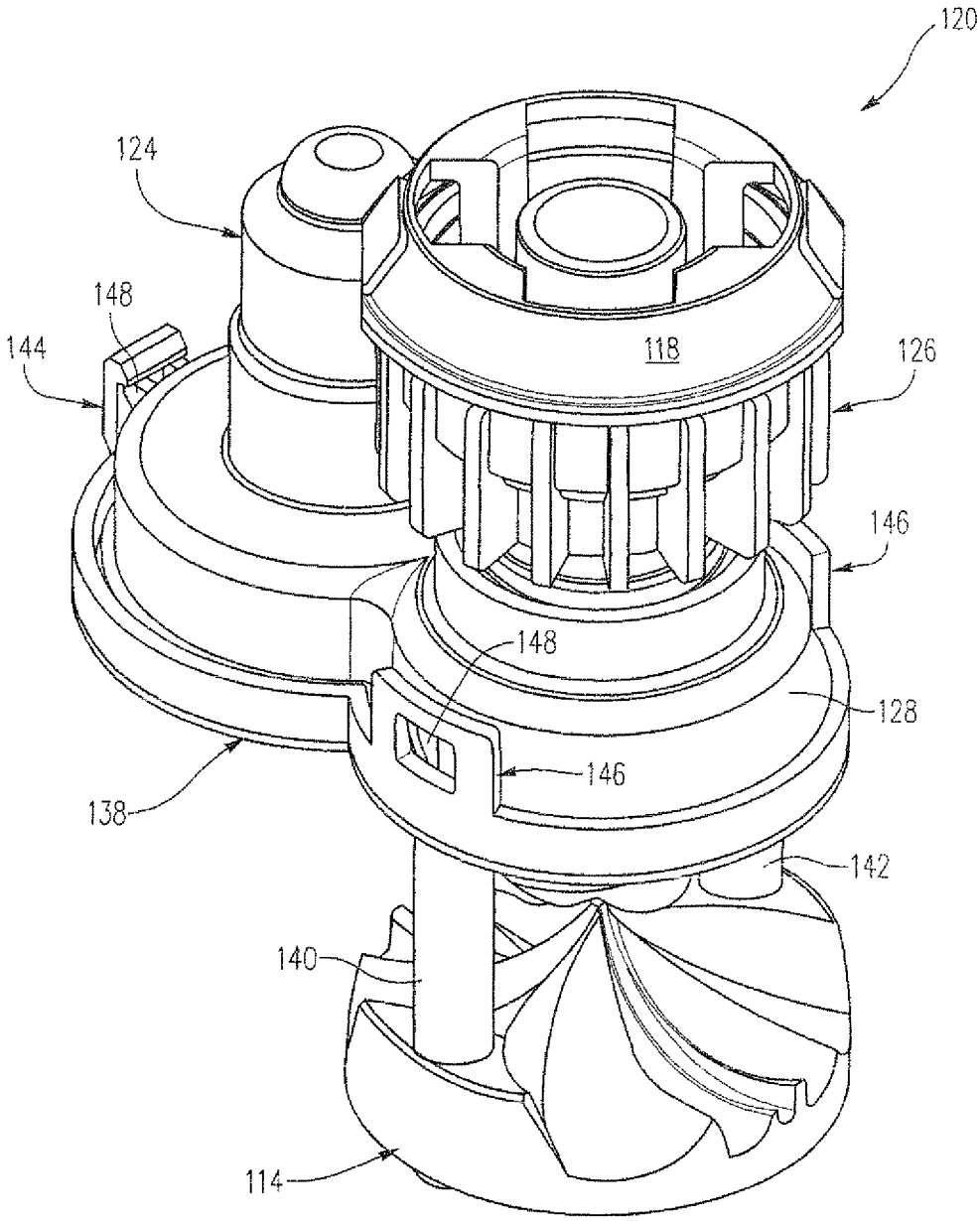
FIG. 13 is a top right perspective view of a second exemplary but nonlimiting embodiment of the invention.
Figure 14:
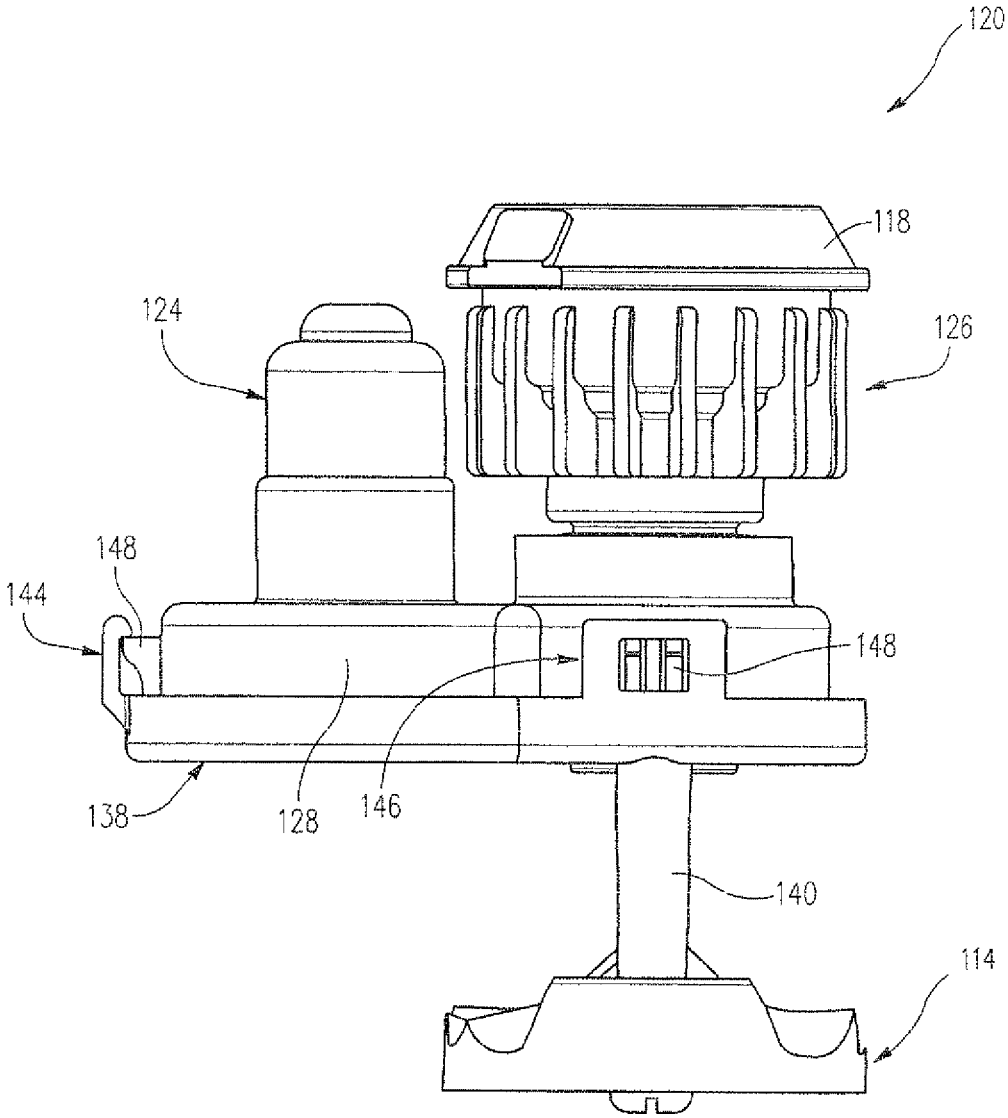
FIG. 14 is a front elevation view of the sprinkler shown in FIG. 13.
Figure 15:
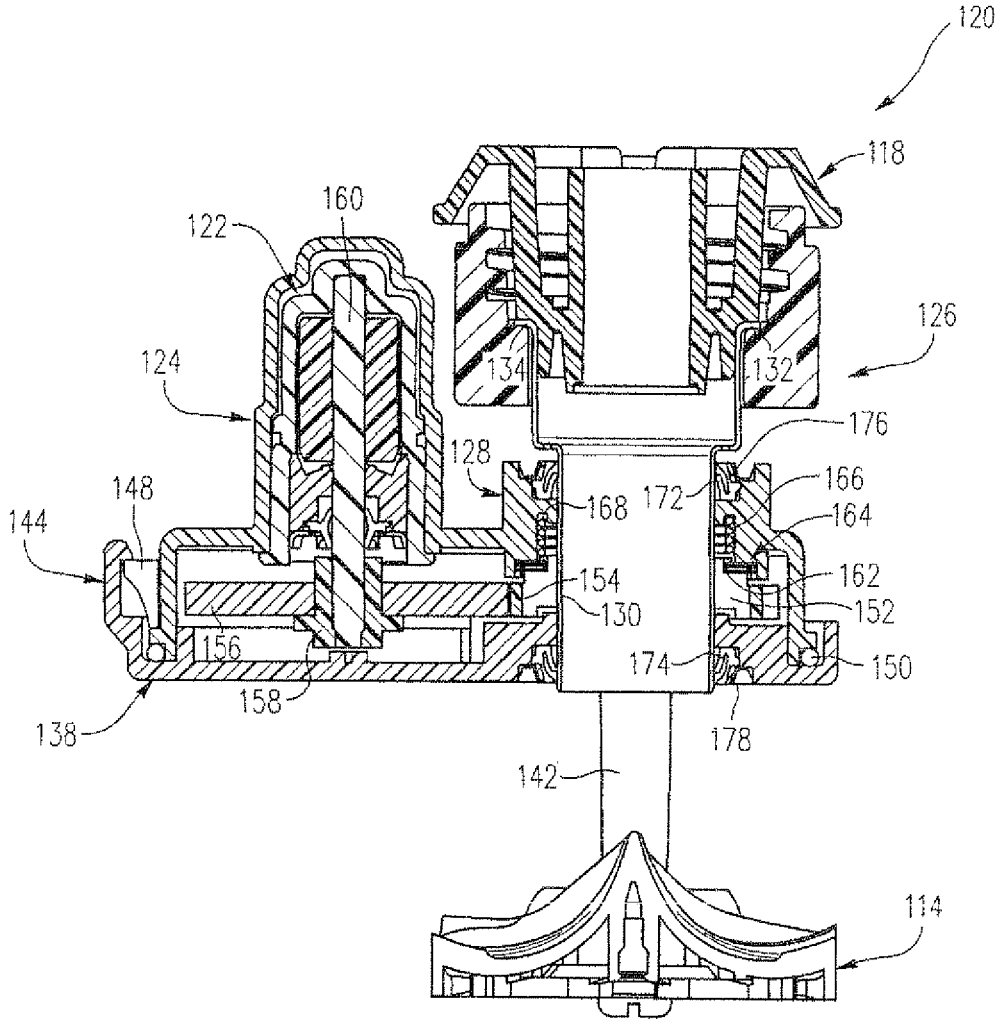
FIG. 15 is a cross section of the sprinkler shown in FIG. 14.

Turning now to FIGS. 13-15, another exemplary but non-limiting implementation of a rotating sprinkler 120 is shown. In this design, the rotary damper (or viscous motor) 122 is located within an offset housing 124 that is not fixed to the sprinkler body 126. Rather, the housing 124 is integrated with the axially-moveable and rotatable sleeve portion 128 that is concentrically arranged about a hollow sprinkler body stem 130. As a result, the rotary damper swings or orbits about the elongated, hollow sprinkler stem 130 along with the deflection plate 114. Stem 130 is formed with an upper radial flange 132 which seats on an inner shoulder 134 on the sprinkler body 126 and is held in place by nozzle 118. The stem 130 thus remains stationary during rotation. Otherwise, the manner in which the water-deflection plate 114 is slowed continually by the viscous damper, and intermittently by the friction-disc mechanism, is substantially as described above. Structurally, however, there are differences in addition to those already noted. A lower frame member 138 supports the housing 124 (including sleeve portion 128), and the deflection plate struts 140, 142 depend from frame 138. The frame 138 and deflection plate 114 assembly is attached to the housing 124 via a flex latch 144 and a pair of closed loops, 146 that fit over a pair of bosses 148 formed on the outer wall of the sleeve 128. As best seen in FIG. 15, a sleeve-frame seal 150 (o-ring or equivalent) is employed at the sleeve/frame interface.

Within the sleeve portion 128 of the housing 124, a brake hub 152 is fixed to the inner circumference of the stem 130, and a stem gear 154 is fixed to the outer circumference of the hub. Stem gear 154 meshes with the gear 156 that is secured to the hub 158 affixed to shaft 160. The damper or viscous brake mechanism is essentially identical to the earlier-described embodiment and no further description is needed here.

The ring-shaped brake hub 152 is formed with an annular horizontal flange or shoulder 162 that supports plural, alternating rotatable and stationary brake discs 164 that interact with the sleeve wall and brake hub in the same manner as described above. A coil spring 166 extends between an upper edge of the brake hub 152 and an annular groove 168 in the sleeve portion 128, biasing the housing 124 and sleeve portion 128 in a vertically upward direction. With increased pressure on the deflection plate 114, the housing 124 (and sleeve portion 128) will move downwardly along the stem, against the bias of coil spring 166 until the brake discs 164 are frictionally engaged between the brake hub and the sleeve portion, further slowing rotation of the deflection plate. In this construction, only two relatively small stem seals 172, 174 and associated retainers 176, 178 are required along the stem.

Figure 16:
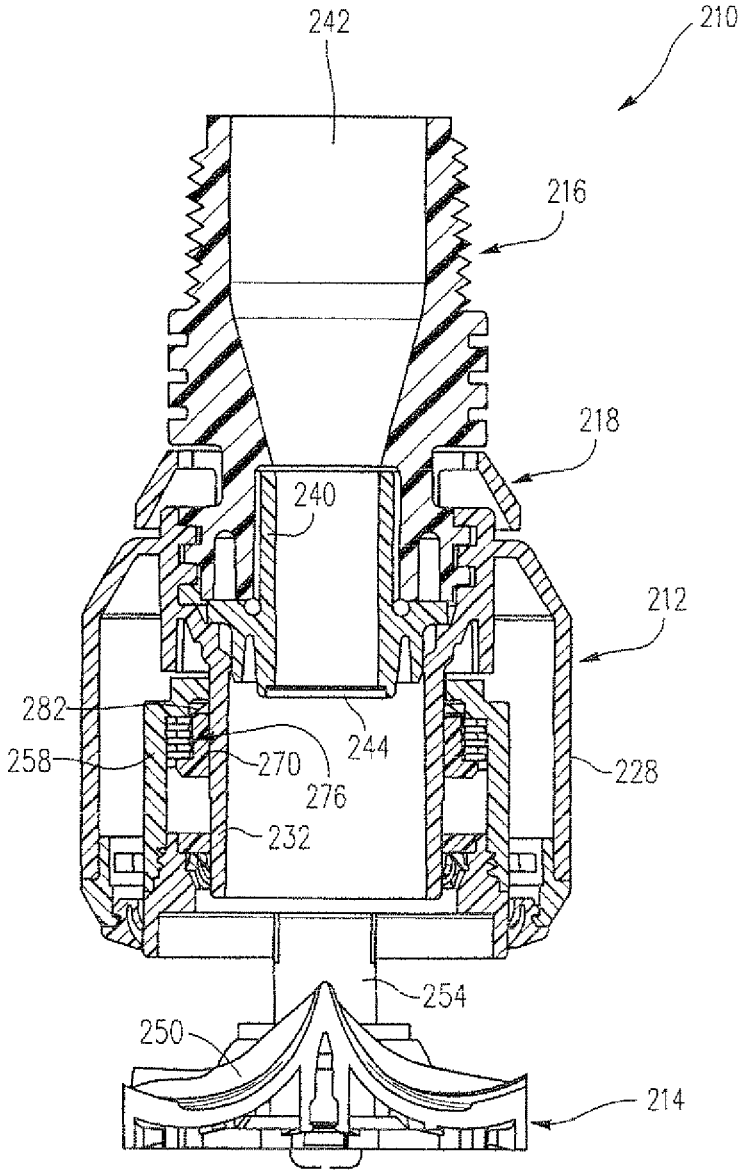
FIG. 16 is a cross section of a third exemplary but nonlimiting embodiment of the invention.

FIG. 16 illustrates another alternative embodiment similar to the embodiment in FIGS. 1-12 but here, the rotary damper (as well as the dummy boss) has been removed. The component parts otherwise replicate the earlier-described embodiment, and thus similar reference numerals, with the prefix "2" added, are used to identify corresponding components, all of which function in a substantially identical manner and, therefore, need not be described again here.

The main difference with this design is that there is no rotary damper, and therefore no gears are required. The intent is to let the water-deflection plate 214 rotate (spin) at a relatively high whirling speed, to facilitate greater breakup of the stream. This design still incorporates a pressure-compensating multi-disc friction brake (including discs 276), and spring 282) to keep the disc brake from actuating with small nozzles and low line pressures. As noted above, with small nozzles and low pressure, the only drag is seal and bearing friction, which can be significant. With sufficient drive built into the deflection plate 214, the unit will spin with small nozzles and low pressure, but might spin overly fast with bigger nozzles and higher pressure if not for the disc brake. The multi-disc friction brake is thus intended to allow the unit to spin at a relatively constant speed over a wide range of nozzles and pressures.

Returning to FIGS. 1 and 2, the path of water flowing down the outer surface of the supply pipe onto the sprinkler is shown by means of flow arrows. Thus, water streams flowing downward on the cylindrical wall 28, for example, will adhere to the lower annular seal 107 via capillary action and surface tension, and eventually drip off the seal at a location inside the outer diameter of the water-deflection plate 14. In this way, the so-called "drool" water will drip into the streams emitted from the plate and be flung radially outwardly with those streams.

Ribs 102, 111 along the interface of side housings 22, 24 with center body portion 20 also serve to channel the drool water towards the plate 14. Also, note that the water-deflection plate 14 is formed with an upper lip 113 that assists in channeling the drool onto the side streams.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A rotary sprinkler comprising a sprinkler body including a nozzle, a water-deflection plate supported for rotational movement relative to said sprinkler body, said water-deflection plate having one or more grooves configured to cause said water-deflection plate to rotate when impinged upon by a stream emitted from the nozzle;

a first brake arranged to slow rotation of the water-deflection plate at all times; and a second brake arranged to further slow rotation of the water-deflection plate as a function of water pressure exerted on the water-deflection plate such that rotation speed of the water-deflection plate decreases as water pressure on the water-deflection plate increases.

2. The rotary sprinkler of claim 1 wherein said water-deflection plate is supported on a sleeve for limited axial movement along a longitudinal axis extending through said nozzle, said second brake actuated by axial movement of said water-deflection plate away from said nozzle.

3. The rotary sprinkler of claim 2 wherein said second brake comprises a plurality of brake discs engaged by a sleeve within said sprinkler body to which said water-deflection plate is connected.

4. The rotary sprinkler of claim 3 wherein axial movement of said water-deflection plate in a direction away from said nozzle is resisted by a spring.

5. The rotary sprinkler of claim 3 wherein said plurality of discs comprise a first group of axially moveable but nonrotatble discs and a second group of axially moveable rotatable brake discs interleaved with said first group of discs.

6. The rotary sprinkler of claim 1 wherein said second brake is independent of said first brake.

7. The rotary sprinkler of claim 6 wherein said first brake comprises a viscous damping mechanism and said second brake comprises a multi-disc friction mechanism.

8. The rotary sprinkler of claim 2 wherein said viscous brake is operatively connected to said deflection plate by a gear train.

9. The rotary sprinkler of claim 8 wherein a first gear is supported within said sprinkler body on said sleeve and said viscous brake includes a second gear carried on a shaft and arranged to mesh with said first gear.

10. A rotary sprinkler comprising a sprinkler body including a nozzle, a water-deflection plate supported on an axially-moveable sleeve via plural struts extending between said sleeve and said water-deflection plate for rotational and limited axial movement relative to said sprinkler body, said water-deflection plate having one or more grooves configured to cause said water-deflection plate and said sleeve to rotate when impinged upon by a stream emitted from the nozzle;

a viscous brake laterally offset from said sleeve and operatively connected to said sleeve for slowing rotation of said sleeve and said water-deflection plate.

11. The rotary sprinkler of claim 10 wherein said viscous brake includes a chamber at least partially filled with a viscous fluid, a rotor fixed to a shaft, and a stator in contact with said viscous fluid.

12. The rotary sprinkler of claim 11 wherein said viscous brake is operatively connected to said sleeve by a gear train.

13. The rotary sprinkler of claim 10 wherein said sprinkler body includes a center housing and said viscous brake is enclosed in a first side housing on one side of said center housing, and wherein a second side housing is located diametrically opposite said first side housing.

14. The rotary sprinkler of claim 12 wherein a first gear is supported within said sprinkler body and a second gear is carried by said shaft.

15. The rotary sprinkler of claim 13 wherein said first side housing is at least partially filled with a viscous fluid.

16. A rotary sprinkler comprising a sprinkler body including a nozzle, a water-deflection plate supported for rotational movement relative to said sprinkler body, said water-deflection plate having one or more grooves configured to cause said water-deflection plate to rotate when impinged upon by a stream emitted from the nozzle;

a brake mechanism adapted to slow rotation of said deflection plate as a function of water pressure exerted on said deflection plate; and wherein said water-deflection plate is supported for limited axial movement along a longitudinal axis extending through said nozzle, said brake mechanism actuated by axial movement of said deflection plate away from said nozzle.

17. The rotary sprinkler of claim 16 wherein said brake comprises a plurality of brake discs engaged by a sleeve within said sprinkler body to which said water-deflection plate is connected.

18. The rotary sprinkler of claim 17 wherein axial movement of said water-deflection plate in a direction away from said nozzle is resisted by a spring.

19. The rotary sprinkler of claim 17 wherein said plurality of discs comprise a first group of axially moveable but non-rotatable discs and a second group of axially moveable rotatable brake discs interleaved with said first group of discs.

20. The rotary sprinkler of claim 13 wherein said first and second side housings are each provided with one or more longitudinally-extending ribs that serve to channel drool water towards said water-deflection plate.

* * * * *